US007901110B2

(12) United States Patent
Mulay et al.

(10) Patent No.: US 7,901,110 B2
(45) Date of Patent: Mar. 8, 2011

(54) SYSTEM AND METHOD FOR FORCED COOLING OF LAMP

(75) Inventors: Amol Suresh Mulay, Bangalore (IN); Viktor Karoly Varga, Solon, OH (US); Gary Robert Allen, Chesterland, OH (US); Sairam Sundaram, Guilderland, NY (US); Svetlana Selezneva, Schenectady, NY (US); Vijaykumar Mallappa Kannure, Secunderabad (IN); Rocco Thomas Giordano, Garfield Heights, OH (US)

(73) Assignee: General Electric Company, Niskayuna, NY (US)

( * ) Notice: Subject to any disclaimer, the term of this patent is extended or adjusted under 35 U.S.C. 154(b) by 1684 days.

(21) Appl. No.: 11/104,984

(22) Filed: Apr. 12, 2005

(65) Prior Publication Data

US 2006/0226752 A1 Oct. 12, 2006

(51) Int. Cl.
*F21S 8/00* (2006.01)

(52) U.S. Cl. ..... 362/277; 362/264; 362/286; 362/373; 362/294; 313/11; 313/12; 313/22

(58) Field of Classification Search ..... 362/264, 362/263, 277, 286, 296, 373, 210, 294, 319; 313/11, 12, 22, 24, 35
See application file for complete search history.

(56) References Cited

U.S. PATENT DOCUMENTS

| | | | | |
|---|---|---|---|---|
| 2,374,497 | A * | 4/1945 | Pophal | 362/261 |
| 3,760,096 | A * | 9/1973 | Roth | 348/750 |
| 4,935,853 | A * | 6/1990 | Collins | 362/272 |
| 5,204,578 | A * | 4/1993 | Dever et al. | 313/25 |
| 6,227,686 | B1 * | 5/2001 | Takahashi et al. | 362/345 |
| 6,400,067 | B1 | 6/2002 | Manning et al. | 313/46 |
| 6,435,699 | B2 | 8/2002 | Glowach, Sr. et al. | 362/294 |
| 6,570,303 | B2 | 5/2003 | Okazaki | 313/113 |
| 2001/0010447 | A1 | 8/2001 | Yamane et al. | 313/113 |
| 2003/0034737 | A1 | 2/2003 | Moench et al. | 315/32 |
| 2003/0086271 | A1 * | 5/2003 | Masuoka et al. | 362/345 |
| 2004/0119413 | A1 * | 6/2004 | Kebbede et al. | 313/624 |
| 2004/0119414 | A1 * | 6/2004 | Bewlay et al. | 313/636 |
| 2004/0135510 | A1 * | 7/2004 | Bewlay et al. | 313/624 |

* cited by examiner

*Primary Examiner*—Sandra L O Shea
*Assistant Examiner*—Danielle Allen
(74) *Attorney, Agent, or Firm*—Patrick K. Patnode

(57) ABSTRACT

A gas discharge lamp includes an arc envelope and a cooling device. Cooling passage is provided between the arc envelope and the cooling device. An airflow blocking structure is mounted rotatably to the arc envelope. The airflow blocking structure blocks airflow between the cooling device and the arc envelope except for a portion of the passage directed towards a top side of the arc envelope.

25 Claims, 12 Drawing Sheets

112

| Air flow (scfh) | Side (T) | Bottom (T1) | Top (T4) | Temp gradient (T4-T1) |
|---|---|---|---|---|
| 0 | 1083.2 | 1011.5 | 1160.7 | 149.3 |
| 1 | 1024.7 | 987.1 | 1039.2 | 52.1 |
| 2 | 1001.6 | 974.5 | 1001.6 | 27.1 |
| 3 | 975.0 | 963.8 | 980.3 | 16.5 |
| 4 | 947.2 | 942.4 | 951.1 | 8.8 |
| 5 | 912.0 | 906.1 | 909.1 | 2.9 |

130 132 134 136 138 140

114 122 124 126 128

FIG.11

SYSTEM AND METHOD FOR FORCED COOLING OF LAMP

BACKGROUND

The present technique relates generally to a system and method for cooling a lamp and, more specifically, to a cooling technique for a short arc gas discharge lamp.

Gas discharge lamps are used in modern lighting technology including fluorescent lighting, liquid crystal displays, indicator lamps, germicidal lamps, neon signs, photographic electronic flashes, video projectors, or the like. Typically, gas discharge lamps comprise a gas filled inside a glass, quartz, or translucent ceramic arc tube. These lamps also include a pair of electrodes, which are energized to create a discharge within the arc tube to ionize the gas. The ionized gas, in turn, generates visible and/or ultraviolet light.

The performance of gas discharge lamps for video projectors depends at least partially on a relatively small arc gap (e.g., on the order of 1 mm) formed between the pair of electrodes located inside the arc tube and, also, a relatively high pressure (e.g., on the order of 100 to 400 atmospheres) of the gas filled inside the arc tube. The use of a ceramic tube rather than a quartz tube enables the gas discharge lamp to operate at higher operating temperatures within the lamp tube. In turn, the ceramic tube enables the gas discharge lamp to operate at a relatively higher vapor pressure with a commensurate reduction in the arc gap between the pair of electrodes. These advantages also lead to improvements in the spectral output of the gas discharge lamp.

In operation, these gas discharge lamps generally have temperature differentials, which can lead to stresses that reduce the lifespan of the lamp. For example, tensile stresses are predominant in the ceramic arc tube due to a large coefficient of thermal expansion in combination with a large temperature difference between a top and bottom side of the arc tube. Unfortunately, passive convective cooling of the arc tube is insufficient to reduce the tensile stresses to an acceptable level.

Therefore, there is a need for a system and method for reducing temperature differentials in the walls of a ceramic arc tube to reduce potential stresses.

BRIEF DESCRIPTION

In accordance with one embodiment of the present technique, a gas discharge lamp is disclosed. The gas discharge lamp includes an arc envelope and a cooling mechanism including a cooling passage reorientable towards a top side of the arc envelope in a plurality of different positions of the arc envelope.

In accordance with another embodiment of the present technique, a method of operating a lamp is disclosed. The method includes reducing a temperature differential between a top and a bottom side of an arc envelope by channeling airflow towards the top side of the arc envelope.

DRAWINGS

These and other features, aspects, and advantages of the present invention will be better understood when the following detailed description is read with reference to the accompanying drawings in which like characters represent like parts throughout the drawings, wherein:

FIG. 11 is a table illustrating measured temperature data of the arc envelope in accordance with the aspects illustrated in accordance with FIG. 10.

DETAILED DESCRIPTION

As discussed in detail below, embodiments of the present technique provide cooling mechanisms configured to focus a cooling airflow on a lamp module (e.g., a ceramic arc tube) to achieve a desired temperature distribution, thereby improving the life span and performance of the lamp module. For example, hot spot temperature of the lamp module may be reduced by approximately 200 degrees. Specifically, techniques are disclosed for focusing a cooling airflow on a top portion of the lamp module where heat is relatively greater, thereby reducing thermal stresses associated with a temperature differential between top and bottom sides of the lamp module. Also, techniques are disclosed for maintaining the focused airflow in the desired region of the lamp module despite the orientation of the lamp module. In other words, if the lamp module is rotated or flipped over, then embodiments of the cooling mechanisms reorient the cooling airflow to maintain the focus of the cooling airflow on the top portion of the lamp module. Various embodiments of these techniques are discussed in further detail below with reference to FIGS. 1-12.

Figure 1:
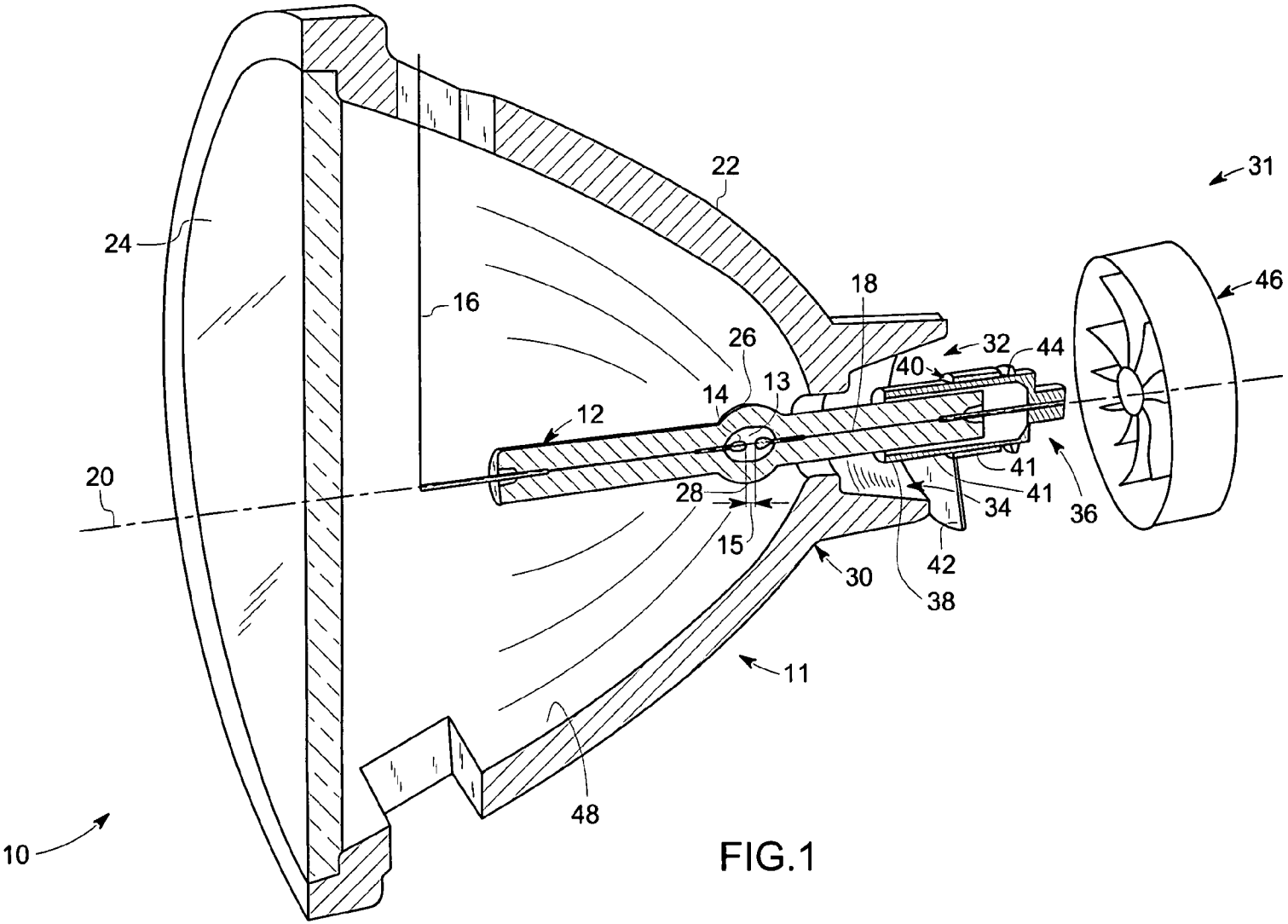
FIG. 1 is a partial front perspective view of an exemplary lamp having cooling mechanisms in accordance with certain aspects of the present technique.

FIG. 1 illustrates an enclosed lamp assembly 10 including a short arc lamp module 11. The lamp assembly 10 may be used in video projectors, fiber optic illuminators, televisions, lighting headsets of surgeons, endoscopic applications, outdoor lighting or stage lighting, automotive headlamps, marine lighting, public transportation lighting (e.g., buses, trains, airplanes, boats, etc.), and other suitable applications. The lamp module 11 includes a hermetically sealed arc envelope 12. The arc envelope 12 may be formed from a variety of materials such as transparent ceramics and other materials, such as yttrium-aluminum-garnet, ytterbium-aluminum-garnet, microgram polycrystalline alumina, alumina or single crystal sapphire, yttria, spinel, ytterbia, polycrystalline alumina, quartz, or the like. The arc envelope 12 may be a hollow cylinder, a hollow elliptical shape, a hollow sphere, a bulb shape, a rectangular shaped tube, or another suitable hollow light-transmissive body.

The illustrated lamp module 11 includes two electrodes 14 provided inside the arc envelope 12. The electrodes 14 may be formed from tungsten, molybdenum, or any other suitable materials. The lamp module 11 also includes lead wires 16 and 18 extending outside the arc envelope 12 and coupled to the two electrodes 14, which terminate inside a cavity 13 within the arc envelope 12. The cavity 13 of the arc envelope 12 is typically filled with a noble gas, such as helium, neon, argon, krypton, xenon, or the like, and dosed with mercury. The cavity is also typically dosed with a halogen like bromine or iodine or chlorine. In addition, the cavity 13 may be dosed or filled with other materials, typically metal halides such as thallium, indium, sodium iodide, or the like. The pressure of gas filled inside the arc envelope 12 is typically above 1 atmosphere during non-operating condition of the lamp module 11. In certain embodiments, the pressure of gas filled inside the arc envelope 12 may be in the range of approximately 100 to 400 atmospheres during operation of the lamp module 11. The electrodes 14 are mounted lengthwise along the arc envelope 12, thereby providing relatively precise control of an arc gap 15 between the tips of the electrodes 14 within the cavity 13. For example, a small arc gap 15 on the order of approximately 1 mm may be formed between the arc electrodes 14. This precise control of the arc gap 15 improves the performance of the lamp module 11. In the illustrated embodiment, the electrode tips are oriented along a centerline 20 of the arc envelope 12. However, alternative embodiments of the lamp module 11 have the electrodes 14 positioned at an offset from the centerline 20, such that the arc is substantially centered within the arc envelope 12. In other embodiments, alternative electrodes 14 may be angled outwardly from the centerline 20, such that the arc is substantially centered within the arc envelope 12.

The enclosed lamp assembly 10 also includes a reflector 22 disposed about a portion of the lamp module 11, such that the light generated by the lamp module 11 is focused in a generally outward direction from the lamp assembly 10. In the illustrated embodiment, the reflector 22 has a parabolic shape. However, other shapes and configurations of the reflector 22 may be employed for a particular application. The illustrated lamp assembly 10 also includes a generally transparent or translucent cover glass 24, such as a glass or plastic cover, coupled to an outer portion of the reflector 22 opposite from the lamp module 11. In certain embodiments, the cover glass 24 may be at least partially colored, doped, or filtered, e.g., to remove red, blue, green, ultraviolet, infrared, or combinations thereof. Accordingly, the reflector 22 and the transparent or translucent cover glass 24 cooperatively enclose and protect the lamp module 11, focus the light output in a desired direction from the lamp module 11, and color the light output from the lamp module 11 if desired for a particular application.

As appreciated by those skilled in the art, an arc is generated between the electrodes 14 by applying voltage across the electrodes 14, causing ionization of the gas filled in the arc envelope 12. The ionized gas, in turn, generates light. In the illustrated embodiment, the arc envelope 12 is formed from ceramic instead of quartz. In comparison, the maximum allowable gas pressure in a quartz arc envelope may be in the range of 150 to 200 atmospheres, whereas the maximum allowable gas pressure in a ceramic arc envelope may be in the range of 200 to 400 atmospheres. The performance of the lamp module 11 is dependent on the arc gap 15 and the gas pressure. The higher temperature capability of a ceramic arc envelope enables higher operating pressures. As known to those skilled in the art, tensile stresses are predominant in the ceramic arc tube due to a large coefficient of thermal expansion in combination with a large temperature difference between a top and bottom side of the arc tube. During operation of the lamp module 11, gas currents are generated inside the arc envelope 12 by convection causing temperatures at a top side 26 of the envelope 12 to be higher than a bottom side 28. In certain other embodiments, the top side 26 may be referred to as "bottom side" and the bottom side 28 may be referred to as "top side" depending on the orientation of the lamp module 11. In other words, heat rises within the cavity 13 due to gas circulation, thereby creating a significant temperature differential between the top side 26 and the bottom side 28. The life of a quartz envelope is typically limited by devitrification of quartz, which is driven by a hot spot temperature, but not by temperature differentials between top and bottoms sides of the quartz envelope. In contrast, the life limitation of a ceramic envelope may be driven by high circumferential tensile stresses generated on an outer side of the envelope 12. The circumferential tensile stresses are generated due to a large coefficient of thermal expansion in combination with the temperature differentials between hot and cold spots in the envelope 12. Additionally compressive stresses are generated inside the envelope 12. Accordingly, in certain embodiments discussed below, forced cooling that selectively cools the top side 26 to a greater extent relative to the bottom side 28 of the envelope 12 reduces these temperature differentials, thereby reducing thermal stresses in the ceramic envelope 12 to desirable levels.

In the illustrated embodiment, the arc envelope 12 is mounted to a neck portion 30 of the reflector 22. The lamp assembly 10 also includes a cooling mechanism 31 to cool the arc envelope 12 in a focused manner as discussed in further detail below. The cooling mechanism 31 includes cooling passages 32 and 34 defined between the arc envelope 12 and the reflector 22. Although two passages 32 and 34 are illustrated, any number of passages may be provided in other embodiments. One cooling passage is above the other cooling passage depending on the orientation of the lamp module 11. In the illustrated embodiment, if the lamp module 11 is mounted in an upright position, the passage 32 is referred as an upper passage and the passage 34 is referred as the bottom passage. If the lamp module 11 is mounted in an inverted position, the passage 32 is referred as the bottom passage and the passage 34 is referred as the top passage. The cooling mechanism 31 also includes an airflow blocking structure 36 rotatably attached to the arc envelope 12. An open portion of airflow blocking structure 36 is above the closed portion of the airflow blocking structure for various orientations of the lamp module 11. Together, the open portion of the airflow blocking structure 36 and the upper one of the passages 32 or 34 define a passage that allows airflow to blow through the lamp module 11 and onto a top side of the lamp module 11. The airflow blocking structure 36 includes a ferrule 38 attached to the arc envelope 12 and located proximate to the cooling passages 32 and 34. The airflow blocking structure 36 further includes a circular ring 40 disposed concentrically about the ferrule 38 with a suitable clearance, such that the circular ring 40 is rotatable about the ferrule 38. The illustrated circular ring 40 has a generally tubular or cylindrically shaped structure 41 and a partial disk-shaped or semi-circular structure 42 protruding outwardly from the tubular structure 41. An open portion of the semi-circular structure 42 and the unblocked passage or unblocked portion of the passage may be referred to as the upper passage. The semi-circular structure 42 is positioned at a bottom side of the lamp module 11, such that airflow cannot pass through the cooling passage 34. Due to the effect of gravity and also due to the clearance formed between the ring 40 and the ferrule 38, the semi-circular structure 42 is always located at a bottom side of the ferrule 38 despite the orientation of the lamp assembly 10. For example, the illustrated lamp assembly 10 could be rotated 360 degrees about the axis 20 and the semi-circular structure 42 would reposition itself downward toward the bottom portion of the passages 32 and 34. The illustrated airflow blocking structure 36 also includes a protrusion 44 formed in the ferrule 38 in a position that restricts axial movement of the circular ring 40. Specifically, the protrusion 44 prevents the ring 40 from sliding outwards along the ferrule 38.

In the illustrated embodiment, a cooling device 46, such as an axial fan or a centrifugal fan, is located at a rear side of the enclosed lamp assembly 10. In the illustrated embodiment, the cooling device 46 forces air toward the reflector 22, the airflow blocking structure 36, and the arc envelope 12. In operation, the airflow blocking structure 36 functions to substantially reduce or block airflow through the cooling passage 34, while allowing the airflow to pass through the passage 32. In this manner, the airflow blocking structure 36 focuses the airflow on the top side 26 of the arc envelope 12, thereby reducing hot spots and temperature differentials between the top and bottom sides 26 and 28 of the arc envelope 12.

Figure 2:
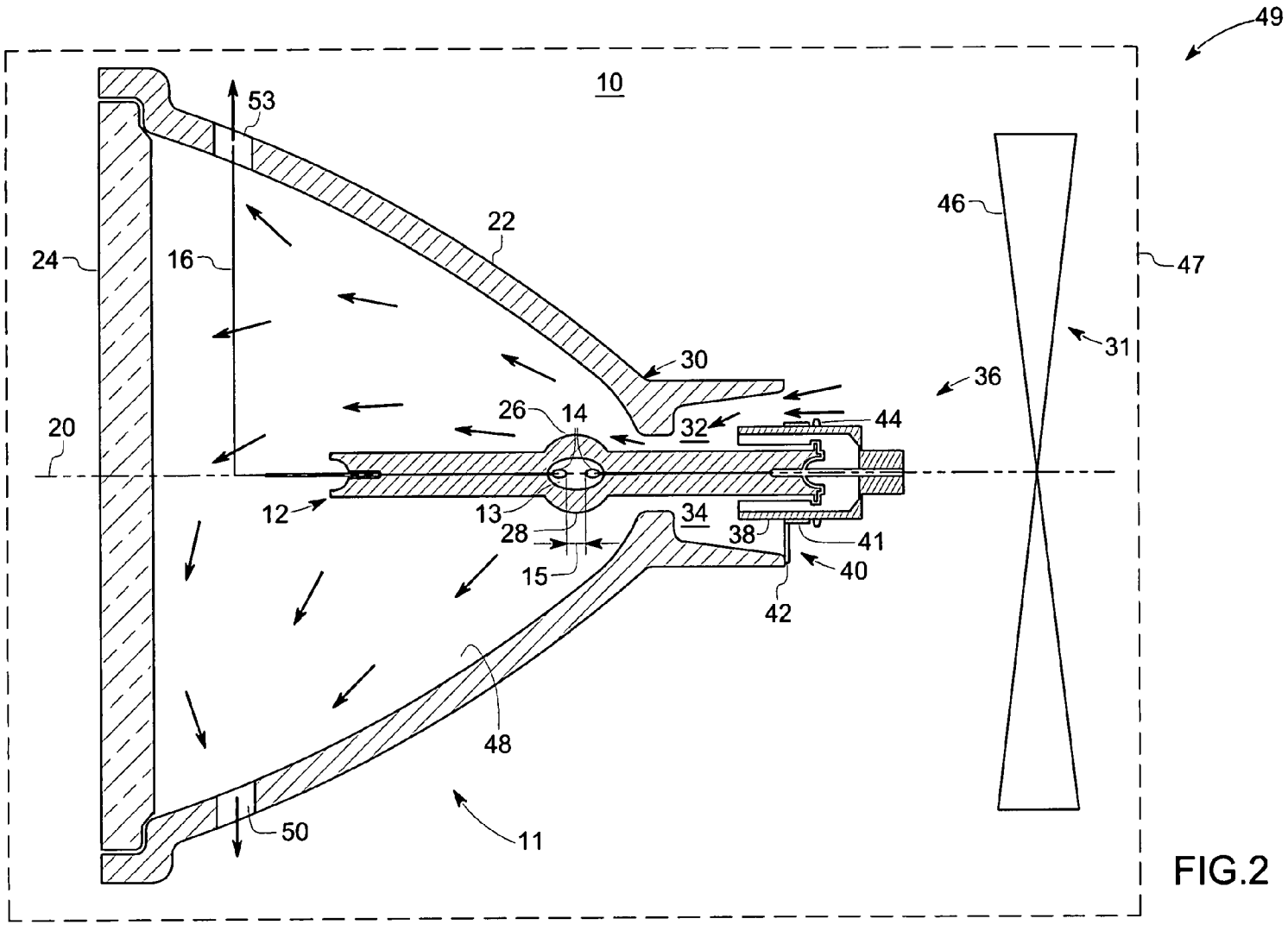
FIG. 2 is a cross-sectional view of the lamp of FIG. 1 illustrating the flow of cooling air through the lamp in accordance with certain aspects of the present technique.

Referring to FIG. 2, an embodiment of the lamp assembly 10 is illustrated inside an enclosure 47 of an electronic device 49, such as a video projector, a television, a fiber optic illuminator, a lighting head set of surgeon, a outdoor lighting or stage lighting, a automotive headlamp, a marine lighting, a public transportation lighting, or another suitable application. The semi-circular structure 42 of the circular ring 40 is located at the bottom side of the ferrule 38 due to the effect of gravity irrespective of the position of the electronic device 49. In another embodiment, the rotation of the ring 40 may be controlled by an electromagnetic/electromechanical mechanism to a desired orientation described in greater detail below. The cooling device 46 forces air in a direction toward the reflector 22, the airflow blocking structure 36, and the arc envelope 12. A portion of the forced air enters a reflector cavity 48 through the cooling passage 32, while the semi-circular structure 42 blocks the airflow through the cooling passage 34. Moreover, the airflow forces the ring 40 to close the cooling passage 34, thereby providing better blockage of the airflow at the cooling passage 34. The air selectively cools the top side 26 of the arc envelope 12 while minimal collateral cooling of the bottom side 28 of the arc envelope 12 occurs. The air inside the reflector cavity 48 is allowed to exit through plurality of openings 50 formed in the reflector 22. In certain other embodiments, cooling fan 46 may be provided outside the reflector 22 and adjacent to the top opening 53 of the reflector 22 to draw air outside through the top opening 53 to selectively cool the top side of the arc envelope 12 while minimal collateral cooling of the bottom side 28 of the arc envelope 12 occurs.

The focused cooling on the top side 26 of the arc envelope 12 reduces the temperature difference between the top side 26 and the bottom side 28 of the arc envelope 12. This arrangement reduces the hot spot temperature of the arc envelope 12. This, ultimately, reduces circumferential thermal stresses generated in the arc envelope 12 irrespective of whether the electronic device 49 and the internal lamp assembly 10 is mounted in a normal position or an upside down position. As a result of this reduced temperature differential, the cooling device 46, the airflow blocking structure 36, and the cooling passages 32 and 34 reduces the likelihood for cracks and increase the life of the lamp module 11. The reduced temperature differential also enables the lamp module 11 to operate at much higher temperatures and operating pressures, thereby improving the performance of the lamp. Thereby fracture of the arc envelope 12 is prevented at higher temperature and operating pressure of the arc envelope 12.

Figure 3:
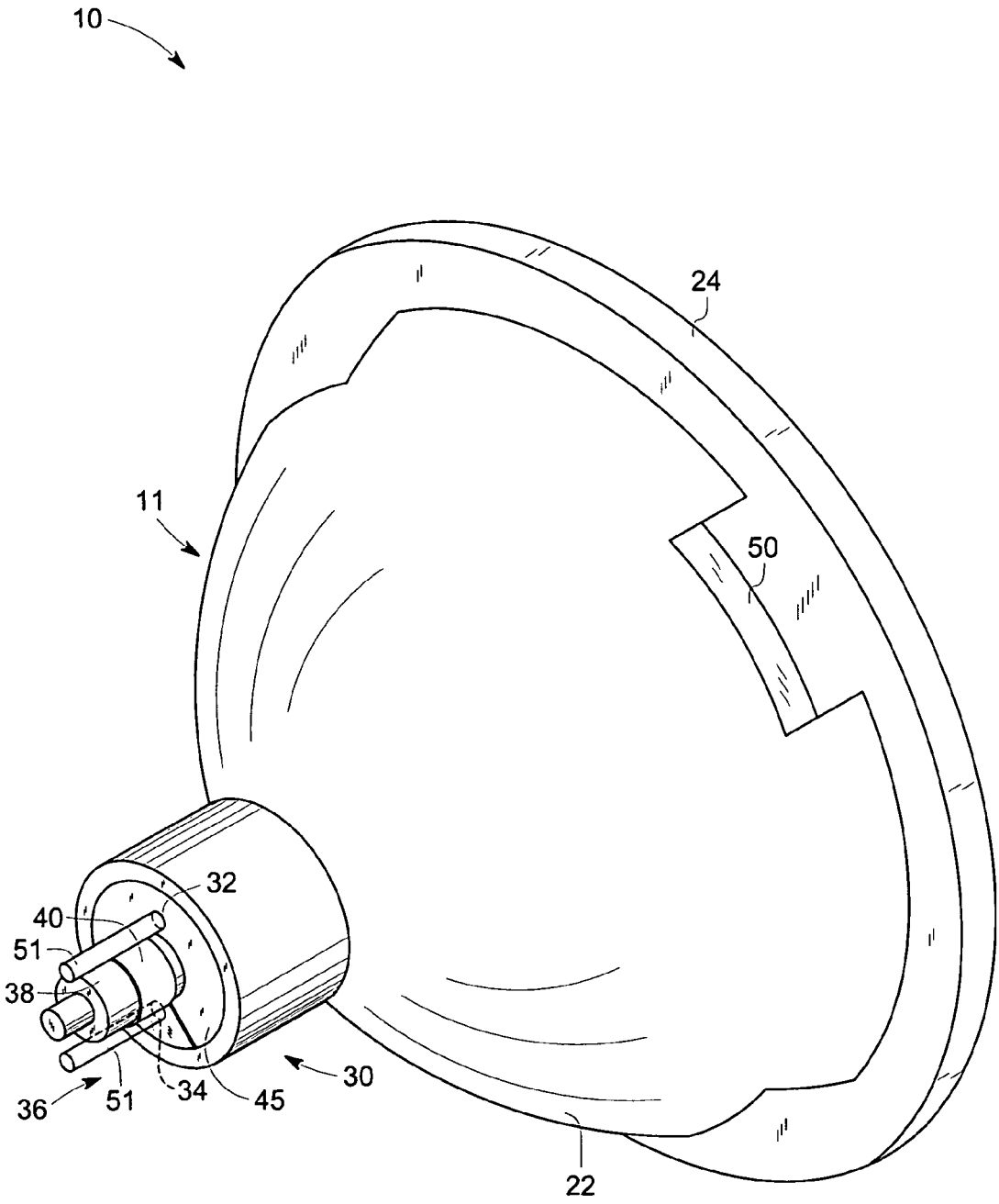
FIG. 3 is a partial rear perspective view of the lamp of FIG. 1 in accordance with certain aspects of the present technique.

Referring to FIG. 3, this figure illustrates a rear perspective view of the lamp assembly 10 in accordance with certain embodiments of the present technique. As illustrated, the plurality of openings 50, 53 are formed in the reflector 22 to allow the cooling airflow, after heat is convectively transferred from the lamp module 11 to the cooling airflow, to flow outwardly from the reflector cavity 48 (shown in FIG. 2). The arc envelope 12 is fixed to the neck portion of the reflector 22 using cement 45. Also illustrated are the cooling passages 32 and 34 formed between the arc envelope 12 and the reflector 22. Two rods 51, such as plastic rods, may be used to form the cooling passages 32 and 34 respectively. The technique used for forming the cooling passages is illustrated in greater detail below. Again, the airflow blocking structure 36 is provided for allowing airflow through the cooling passage 32, while blocking airflow through the cooling passage 34.

Figure 4:
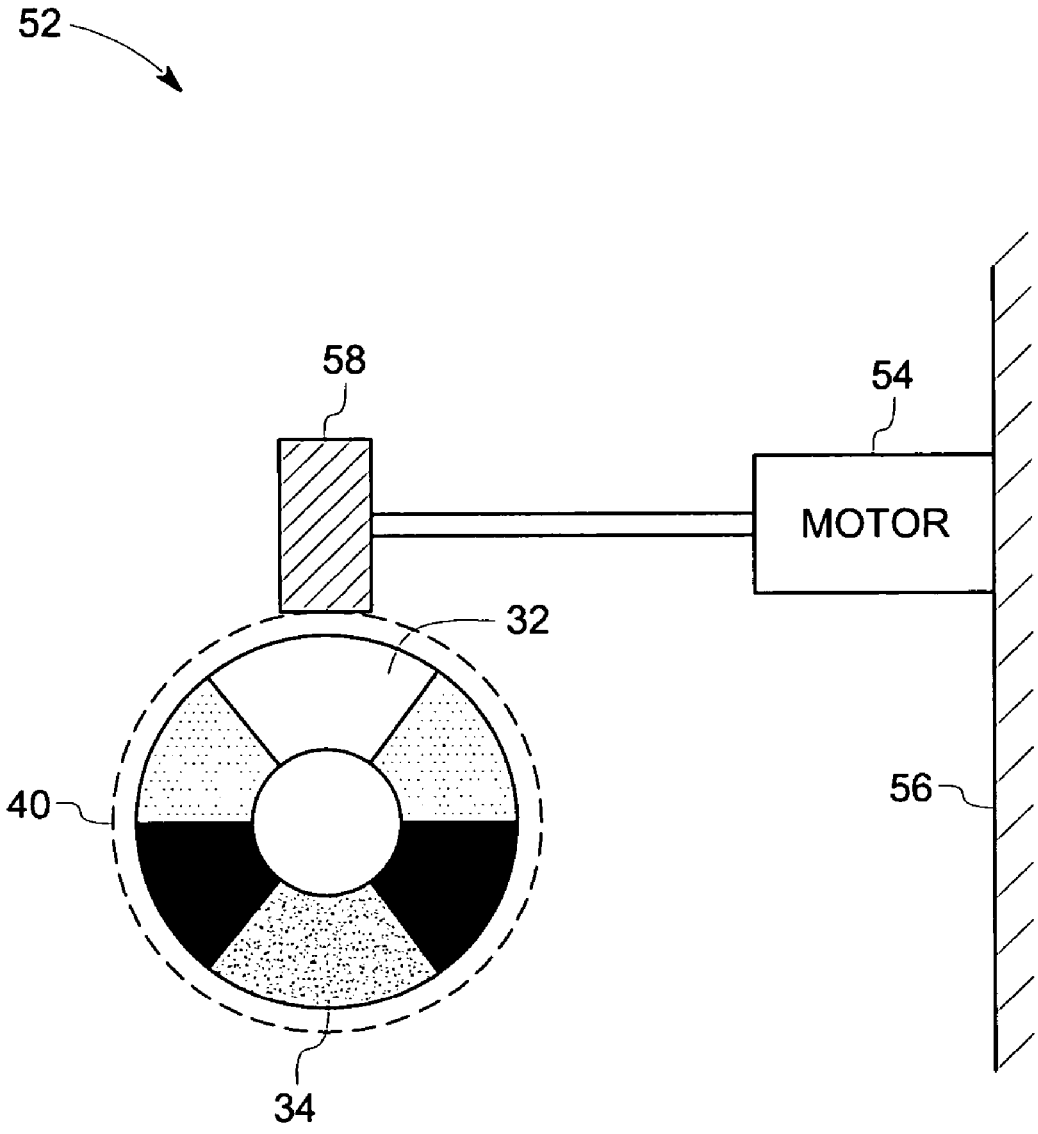
FIG. 4 is a diagrammatical representation of an electromagnetic/electromechanical mechanism configured to move a circular ring to a desired orientation to control airflow through the lamp of FIGS. 1-4 in accordance with certain aspects of the present technique.

Referring to FIG. 4, an electromagnetic/electromechanical mechanism 52 is illustrated for use with the lamp assembly 10 and electronic device 49 of FIGS. 1-3. In the illustrated embodiment, the ring 40 is moved by the mechanism 52 to a desired orientation. The movement of the ring 40 is based on a signal transmitted from an electronic image control unit (not shown). The signal from the electronic image control unit is transmitted based on a flipped position of the electronic device 49.

A motor 54 is mounted to a lamp fixture 56. An electromagnetic signal from the image control unit is transmitted to the motor 54. If the electronic device 49 and/or lamp assembly 10 is mounted in a normal position, the motor 54 is not rotated. If the electronic device 49 and/or lamp assembly 10 is mounted upside down, the motor 54 is rotated by 180 degrees. The motor 54 rotates a pinion 58 and the ring 40. The ring 40 may have a semi-annular groove. The rotation of the ring 40 through 180 degrees results in opening of passage 34 and blockage of passage 32. The mechanism 52 allows airflow through the passage leading to a hot spot region of the arc envelope 12 irrespective of the position of the projector.

Figure 5:
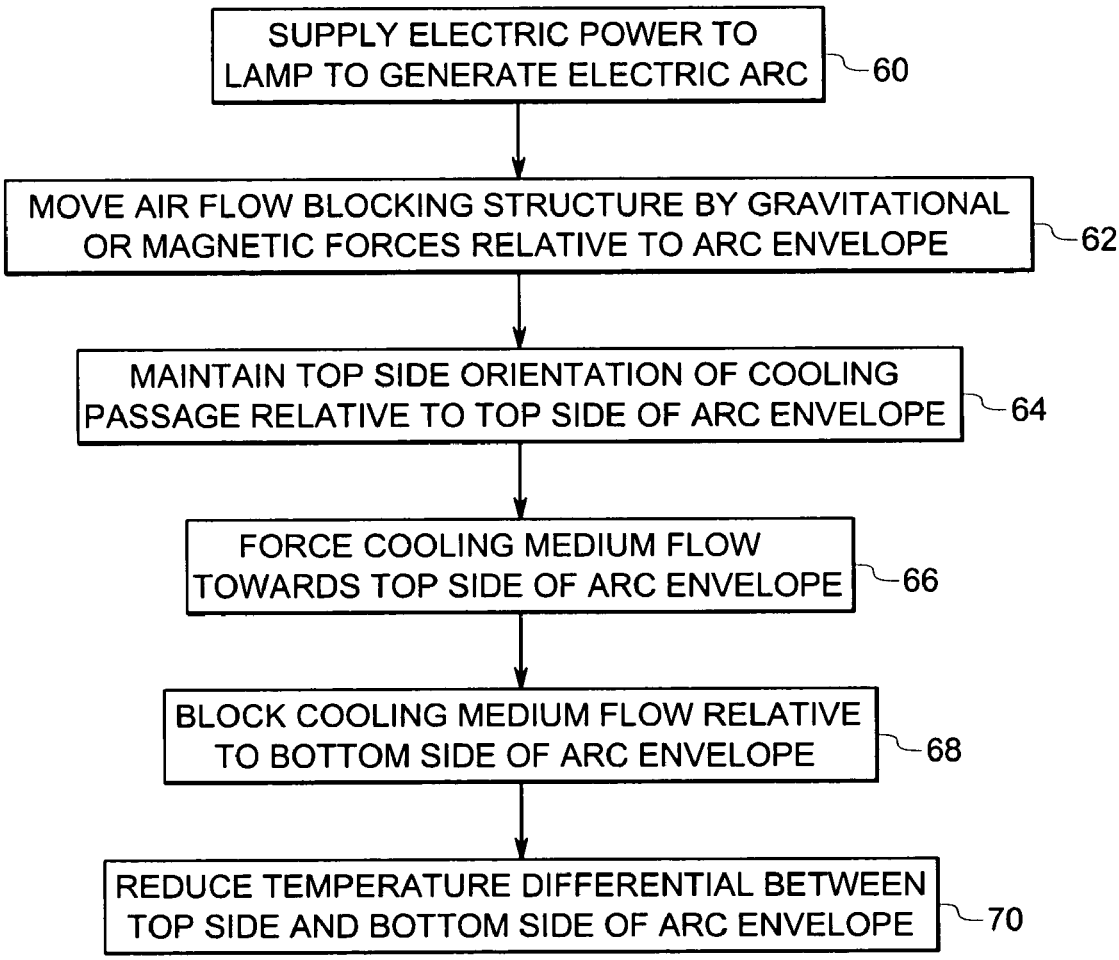
FIGS. 5 and 6 are flow charts illustrating various methods of operation of a lamp having cooling mechanisms in accordance with certain aspects of the present technique.

Referring to FIG. 5, a method of operation of the lamp assembly 10 is illustrated. Electric power is supplied to the lamp assembly 10 to generate an electric arc as represented by step 60. Voltage is applied between the electrodes 14 so that gas in the arc envelope 12 is ionized. The ionized gas generates light. The cooling passage is moved by gravitational or magnetic force relative to the arc envelope 12 depending on the position of the lamp 10 as represented by step 62. For example, the air blocking structure 36 rotatably mounted to the arc envelope 12 is moved by gravitational force or magnetic force. The open/unblocked cooling passage is oriented toward a top side of the arc envelope 12 as represented by step 64. The cooling device configured to supply the cooling medium is provided to the rear side of the lamp assembly 10. The cooling medium is forced through the cooling passage to the top side of the arc envelope 12 as represented by step 66. Cooling medium flows parallely along the top side of the arc envelope 12, thereby forcing convective heat transfer away from the top side of the arc envelope 12 and into the passing cooling medium. The passing cooling medium, having collected heat from the top side of the arc envelope 12, is then allowed to exit through a plurality of openings 50, 53 in the reflector 22. While the cooling medium is allowed to flow along the top side of the arc envelope 12, the cooling medium flow relative to the bottom side of the arc envelope 12 is blocked by the airflow blocking structure 36 as represented by step 68. This results in selective cooling of the top side relative to the bottom side of the arc envelope 12. The temperature differential between the top side and bottom side of the arc envelope 12 is reduced as represented by step 70.

Figure 6:
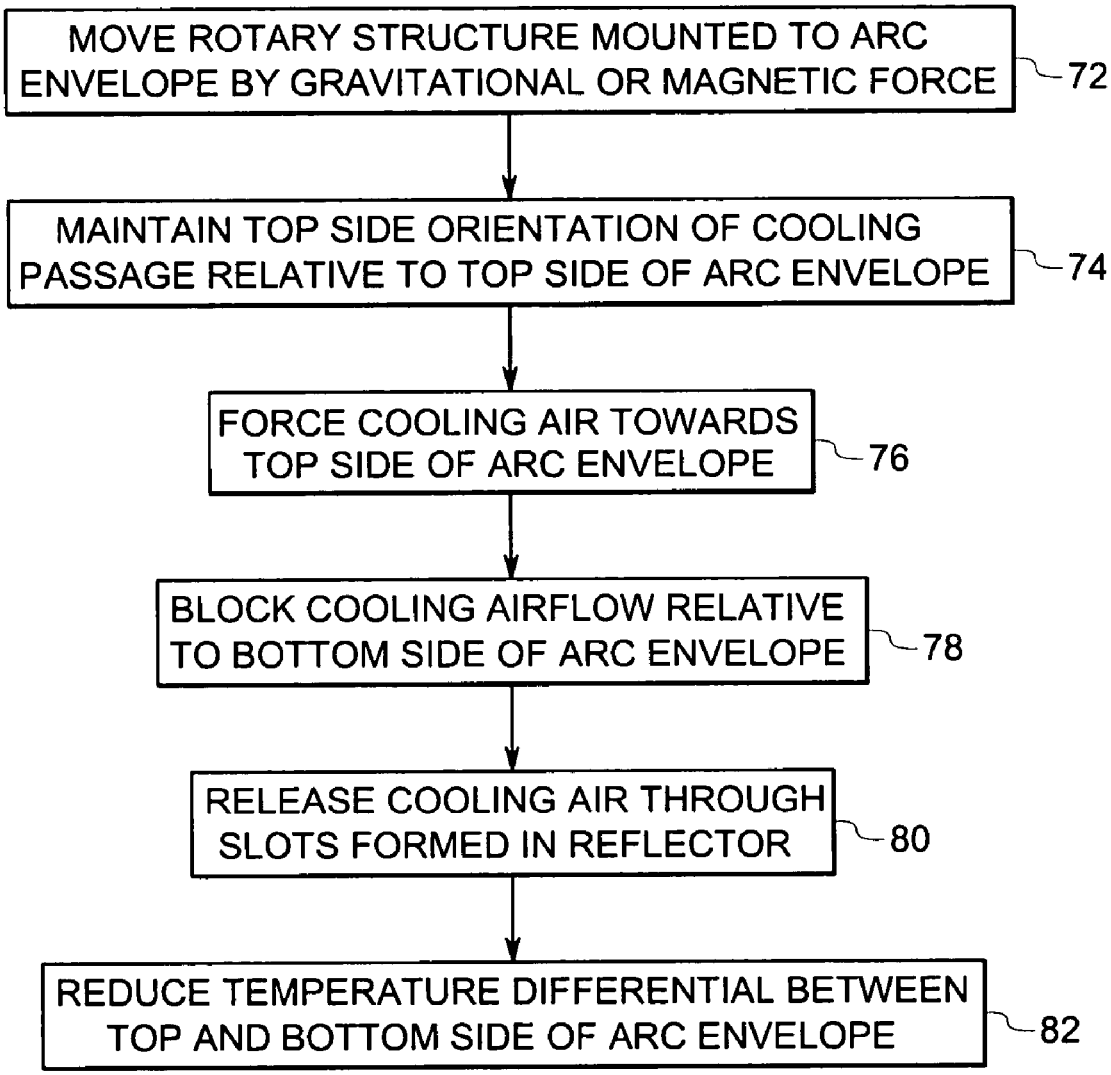

Referring to FIG. 6, one embodiment of the method of operation of the lamp assembly 10 is illustrated. The air blocking structure 36 rotatably mounted to the arc envelope 12 is moved by gravitational or magnetic force depending on the position of the lamp assembly 10 as represented by step 72. In one example, the semi-circular structure 42 of the circular ring 40 is located to the bottom side relative to the ferrule 38 due to the effect of gravity. In the present embodiment, two cooling passages 32 and 34 are provided between the arc envelope 12 and the airflow blocking structure 36. The cooling passage 32 is maintained in an orientation toward the top side of the arc envelope 12 as represented by step 74. The cooling fan 46 is provided to the rear side of the arc envelope 12. The cooling air is forced through the cooling passage 32 to the top side of the arc envelope 12 as represented by step 76. The cooling airflow relative to the bottom side of the arc envelope 12 is blocked as represented by step 78. In the illustrated example, the semi-circular structure 42 of the circular ring 40 is located to the bottom side relative to the ferrule 38. The cooling passage 34 is blocked by the semi-circular structure 42. The cooling air forced through the cooling passage 32 is allowed to exit through plurality of openings 50, 53 formed in the reflector 22 as represented by step 80. This results in selective cooling of the top side relative to the bottom side of the arc envelope 12. The temperature differential between the top side and bottom side of the arc envelope 12 is reduced as represented by step 82.

Figure 7:
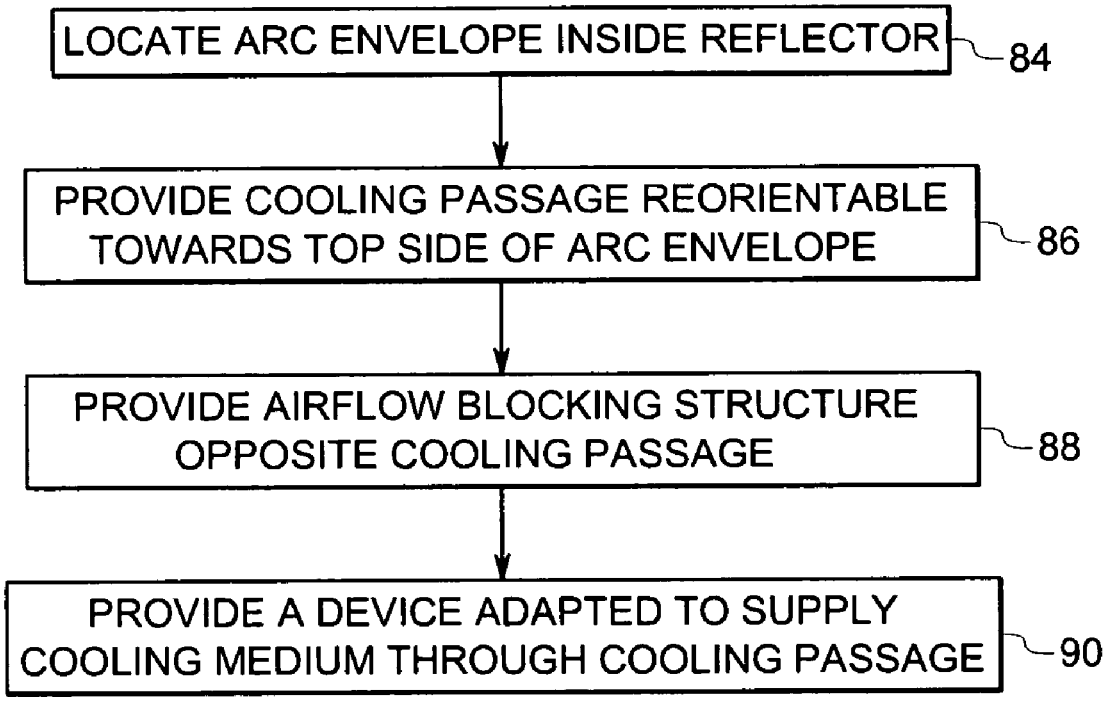
FIGS. 7 and 8 are flow charts illustrating various methods of manufacturing a lamp having cooling mechanisms in accordance with certain aspects of the present technique.

Referring to FIG. 7, a method of manufacturing a lamp is illustrated in accordance with certain embodiments of the present technique. The arc envelope 12 is located inside the reflector 22 as represented by step 84. The arc envelope 12 is coupled to the neck region of the reflector 22. At least one cooling passage is provided in the lamp assembly 10 in a reorientable configuration, which is maintained toward the top side of the arc envelope 12 as represented by step 86. An airflow blocking structure 36 is rotatably mounted to the arc envelope 12 in such a way that the airflow blocking structure 36 is located opposite the cooling passage as represented by step 88. A device adapted to supply cooling medium through the cooling passage is provided at the rear side of the arc envelope 12 as represented by step 90.

Figure 8:
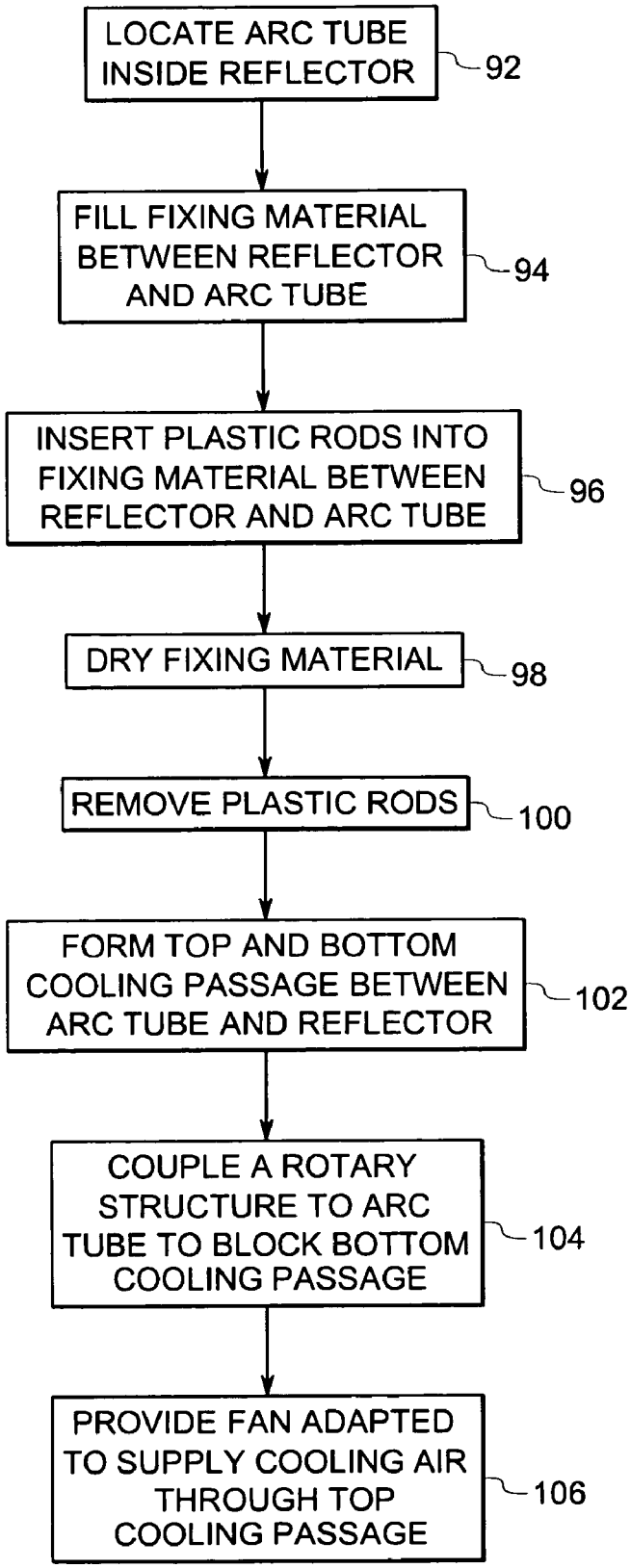

Referring to FIG. 8, one embodiment of the method of manufacturing the lamp assembly 10 is illustrated. The arc envelope 12 is located in the reflector 22 as represented by step 92. In the illustrated example, the arc envelope 12 is an arc tube. A fixing material such as cement is filled between the reflector 22 and the arc envelope 12 as represented by step 94. The fixing material is provided to secure the arc envelope 12 to the reflector 22. In the illustrated embodiment, two rods 51 (shown in FIG. 3) are inserted between the reflector 22 and the arc tube 12 to form cooling passages 32 and 34 as represented by step 96. For example, plastic rods may be used to form the cooling passages. In certain other embodiments, any number of other devices as known by those skilled in the art may be used to form the cooling passages. The fixing material is dried as represented by step 98. The plastic rods are removed after drying of the fixing material as represented by step 100. The cooling passages 32 and 34 are formed between the arc tube 12 and the reflector 22 in the vacancies of the plastic rods as represented by step 102. The airflow blocking structure 36 is rotatably mounted to the arc tube 12 to block the cooling passage 34 as represented by step 104. The cooling fan 46 is provided to the rear side of the arc envelope 12. The cooling fan 46 is adapted to supply cooling air through the cooling passage 32 to the top side of the arc tube 12 as represented by step 106.

Figure 9:
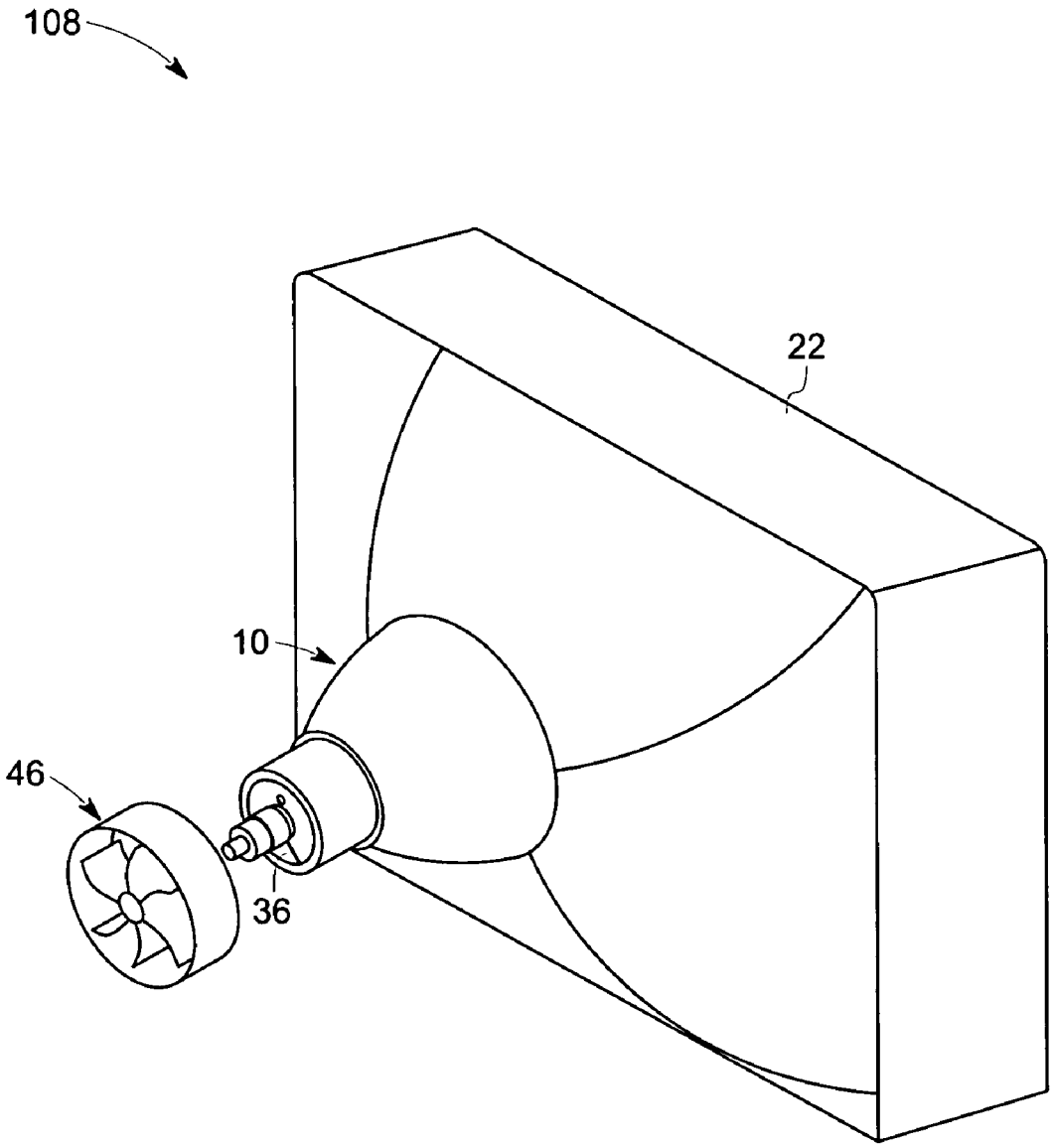
FIG. 9 is diagrammatical representation of a system incorporating a lamp having cooling mechanisms in accordance with certain aspects of the present technique.

Referring to FIG. 9, a system 108 including the lamp assembly 10 is illustrated in accordance with embodiments of the present technique. The system 108 may include a video projector, a television, a fiber optic illuminator, a headset of a surgeon, an endoscopic application, or the like. As discussed above, the lamp assembly 10 includes the arc envelope 12 provided inside the reflector 22. Two electrodes 14 are provided inside the arc envelope 12. The rotatable structure 36 is attached to the arc envelope 12 to provide selective cooling of top side relative to bottom side of the arc envelope 12. The cooling fan 46 is provided to force cooling air through the cooling passage to the top side of the arc envelope 12.

Figure 10:
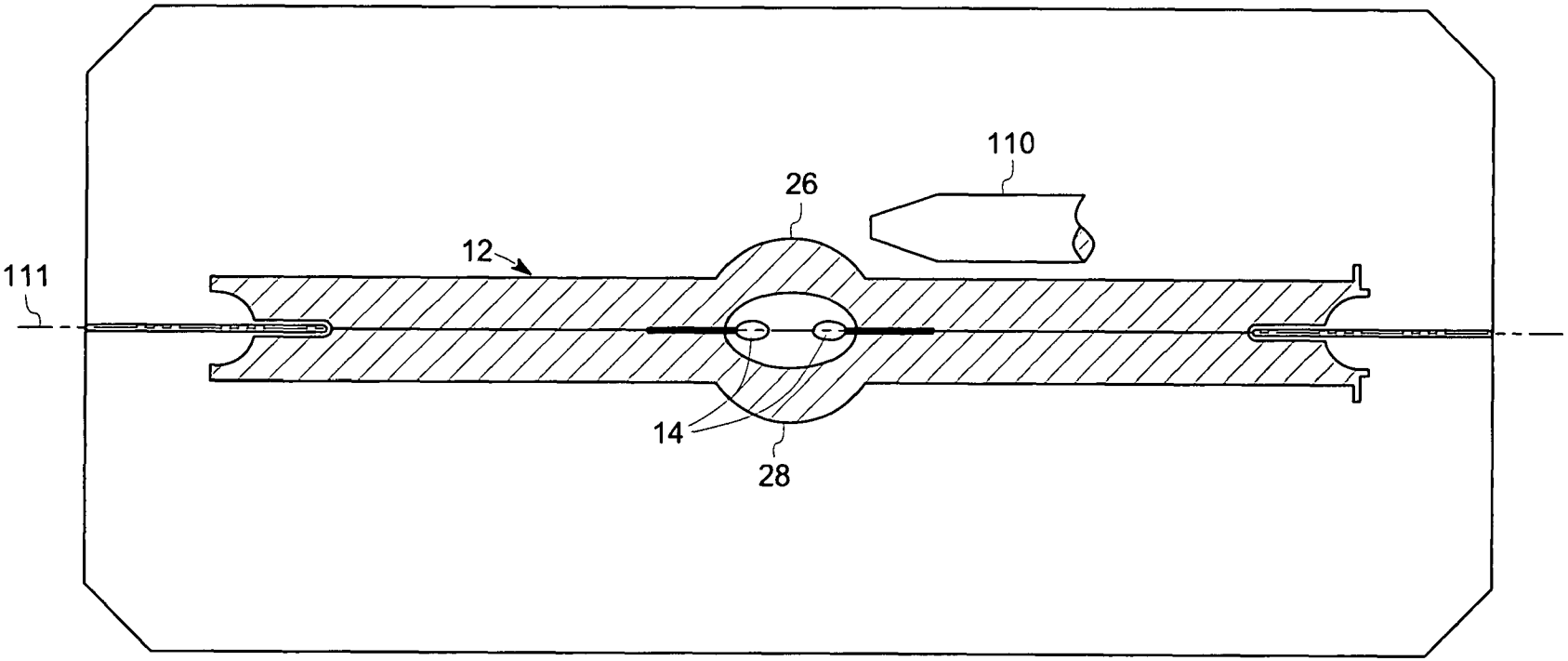
FIG. 10 is a perspective view illustrating a nozzle provided to supply cooling air to a top side of the arc envelope in accordance with certain aspects of the present technique.

Referring to FIG. 10, the arc envelope 12 is illustrated in accordance with embodiments of the present technique. In the illustrated embodiment, a nozzle 110 is provided to inject cooling air to the top side 26 of the arc envelope 12 operated without the reflector. The nozzle 110 is located focusing at the hot spot of the arc envelope 12. As the cooling air blows onto the top side 26, the temperature of the top side 26 of the arc envelope 12 is substantially reduced without significantly cooling the bottom side 28 of the arc envelope 12. In other words, the cooling air reduces temperature differential between the top side 26 and the bottom side 28 of the arc envelope. If the arc envelope is rotated or repositioned (e.g., rotated about axis 111), then the nozzle 110 maintains its topside position (or reorients itself to a topside position) relative to the arc envelope 12. The temperature data of the top and bottom sides 26 and 28 of the arc envelope 12 may be measured using a thermocouple or an imaging pyrometer.

FIG. 11 is a table 112 illustrating data representing differences between the temperature of the top side 26 and the bottom side 28 of the arc envelope 12 relative to the airflow rate directed toward the top side 26. As illustrated, column 114 refers to the airflow rate in units of standard cubic feet per hour (scfh) directed toward the top side 26 of the arc envelope 12. Columns 122, 124, and 126 refer to the temperatures in degrees Celsius of the sides (between top and bottom sides 26 and 28), the bottom side 28, and the top side 26 of the arc envelope 12, respectively. Column 128 refers to the temperature gradient in degrees Celsius of the top side 26 relative to the bottom side 28 of the arc envelope 12. As indicated by rows 130, 132, 134, 136, 138, and 140, the values in each of the foregoing columns 122 through 128 decrease in response to the increasing airflow rates of 0, 1, 2, 3, 4, and 5 standard cubic feet per hour set forth in column 114. More importantly, the temperature at the top side 26 decreases more rapidly than the temperature at the bottom side 28, thereby leading to a gradually smaller temperature gradient as indicated by rows 130 through 140 of column 128. This decreasing temperature gradient is attributed to the focused airflow toward the top side 26 of the arc envelope 12. In other words, the airflow carries heat away from the top side 26, whereas the convective heat transfer at the bottom side 28 is relatively less due to the lack (or relatively lesser amount) of airflow at the bottom side 28. For example, if the airflow rate is 1 standard cubic feet per hour, then the temperature of the bottom side 28 of the arc envelope 12 is 987.1 degree Celsius and the temperature of the top side 26 of the arc envelope 12 is 1039.2 degree Celsius. The temperature difference between the top and bottom sides 26 and 28 of the arc envelope 12 is 52.1 degree Celsius. If the airflow rate is 5 standard cubic feet per hour, then the temperature of the bottom side 28 of the arc envelope 12 is 906.1 degree Celsius and the temperature of the top side 26 of the arc envelope 12 is 909.1 degree Celsius. The temperature difference between the top and bottom sides 26 and 28 of the arc envelope 12 is 2.9 degree Celsius. The stresses generated in the arc envelope 12 are reduced proportional to the reduction in difference between the top and bottom sides 26 and 28 of the arc envelope 12. In the illustrated embodiment, the thermal stresses generated in the arc envelope 12 may be substantially reduced by reducing the temperature difference between the top and bottom sides 26 and 28 of the arc envelope 12.

Figure 12:
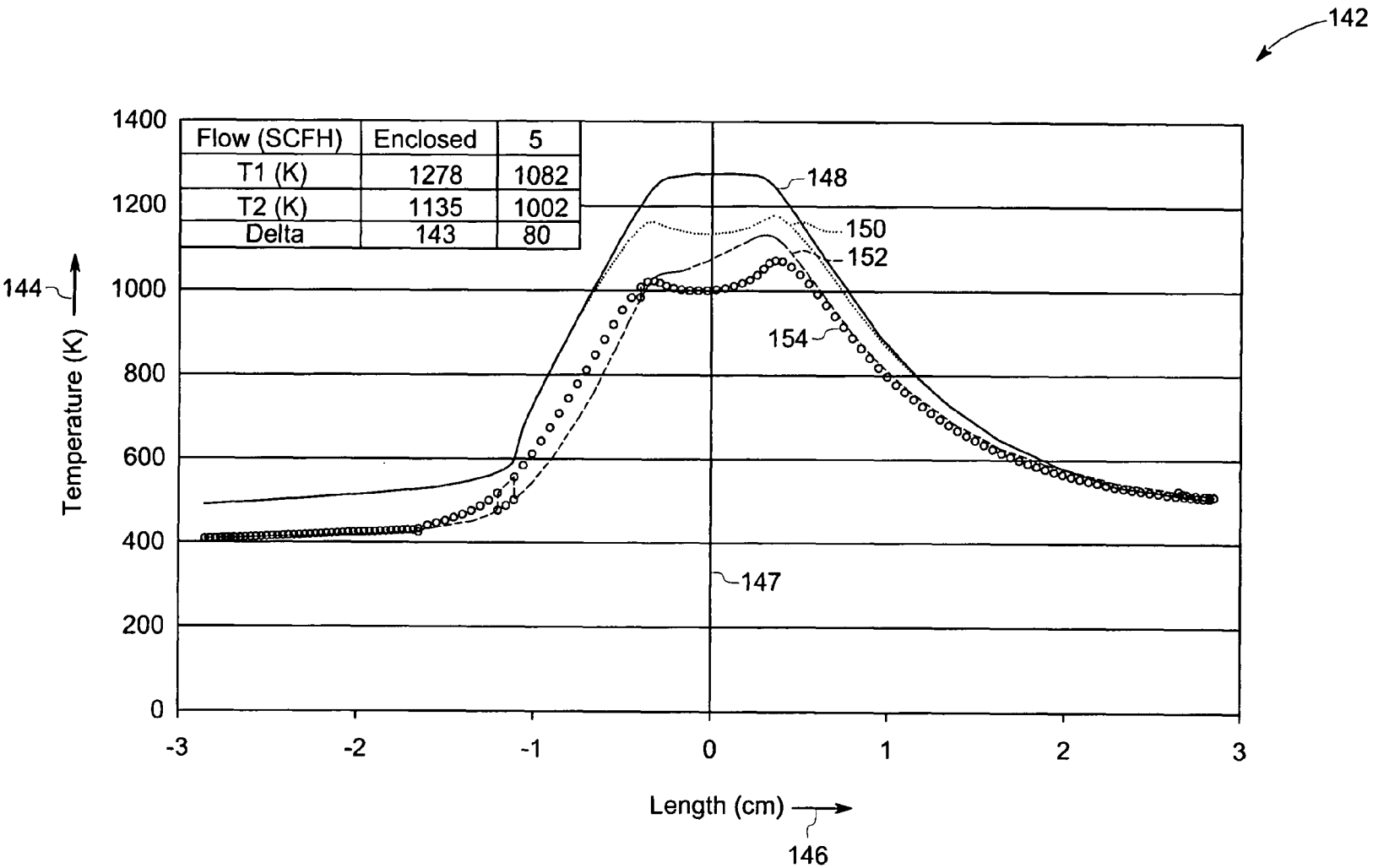
FIG. 12 is a graph illustrating distribution of temperature along the surface of the arc envelope in accordance with certain aspects of the present technique.

Referring to FIG. 12, a graph 142 representing distribution of temperature along the length of the arc envelope 12 provided inside the reflector, is illustrated in accordance with the embodiments of the present technique. As known to those skilled in the art, the temperature distribution along the length of the arc envelope 12 is obtained through numerical simulation technique. Y-axis 144 of the graph 142 represents distribution of temperature in Kelvin and X-axis represents length of the arc envelope 12 in centimeters. A line 147 represents center along the length of the arc envelope 12. Two portions on either sides of line 147 along the X-axis represents two halves on either side of the center respectively. A curve 148 illustrates distribution of temperature along the top side of the arc envelope 12 for an airflow rate of zero scfh. A curve 150 illustrates distribution of temperature along the bottom side of the arc envelope 12 for an airflow rate of zero scfh. Another curve 152 illustrates distribution of temperature along the top side of the arc envelope 12 for airflow rate of 5 scfh directed to the top side of the arc envelope 12. Yet another curve 154 illustrates distribution of temperature along the bottom side of the arc envelope 12 for airflow rate of 5 scfh. In the illustrated example, if no cooling air is supplied during the operation of the lamp module, the temperature at the top side of the arc envelope 12 is 1278 Kelvin and the temperature at the bottom side of the arc envelope 12 is 1135 Kelvin. The temperature difference between the top and bottom side of the arc envelope 12 is 143 Kelvin. If cooling air of 5 cubic feet per hour is supplied to the top side of the arc envelope 12, the temperature at the top side of the arc envelope 12 is 1082 Kelvin and the temperature at the bottom side of the arc envelope 12 is 1002 Kelvin. The temperature difference between the top and bottom side of the arc envelope 12 is 80 Kelvin. Unlike as illustrated in FIG. 11, the airflow is not exactly focused at the hot spot of the arc envelope 12 provided inside the reflector. In fact, the airflow diffuses after entering the cooling passage 32 (shown in FIG. 2). As a result, the temperature gradient of the lamp module may be reduced from 10,000 degrees/meter to 6000 degrees/meter. This increases the life of the lamp.

While only certain features of the invention have been illustrated and described herein, many modifications and changes will occur to those skilled in the art. It is, therefore, to be understood that the appended claims are intended to cover all such modifications and changes as fall within the true spirit of the invention.

The invention claimed is:

1. A gas discharge lamp, comprising:

an arc envelope; and a cooling mechanism comprising a structure rotatably mounted relative to the arc envelope, wherein the structure is reorientable in a plurality of different positions of the arc envelope to provide at least one cooling passage.

2. The lamp of claim 1, wherein the cooling mechanism comprises an airflow blocking structure having a ferrule attached to the arc envelope and a circular ring disposed concentrically about the ferrule with a clearance.

3. The lamp of claim 1, wherein the arc envelope comprises a ceramic material.

4. The lamp of claim 1, wherein the cooling mechanism comprises a fan disposed adjacent the cooling passage.

5. The lamp of claim 2, wherein the circular ring comprises a tubular structure and a partial disk-shaped structure protruding outwardly from the tubular structure and forming at least a portion of the cooling passage.

6. The lamp of claim 5, wherein weight of the structure is off balance toward a side opposite from the portion of the cooling passage.

7. The lamp of claim 5, comprising an electromagnetic device disposed adjacent to the structure, wherein the electromagnetic device is operable to move the structure to orient the portion of the cooling passage toward a top side of the arc envelope.

8. The lamp of claim 1, further comprising a reflector having a plurality of airflow exhaust openings.

9. A system, comprising:

a lamp having an arc envelope provided inside a reflector;

a fan;

an airflow passage disposed between the arc envelope and the fan; and a structure rotatably mounted relative to the arc envelope, wherein the structure blocks airflow between the fan and the arc envelope except for a portion of the airflow passage directed toward a top side of the arc envelope.

10. The system of claim 9, wherein the fan is provided adjacent to the airflow passage or an opening formed in a top side of the reflector.

11. The system of claim 9, wherein the structure is disposed concentrically around the arc envelope.

12. The system of claim 11, wherein the structure comprises a semi-circular structure protruding outwardly from the arc envelope.

13. The system of claim 12, further comprising an electromagnetic or electromechanical device disposed adjacent the structure, wherein the electromagnetic or electromechanical device is operable to control movement of the semi-circular structure.

14. The system of claim 9, wherein the system comprises a video projector.

15. The system of claim 9, wherein the system comprises a television.

16. The system of claim 9, wherein the system comprises a fibre optic illuminator.

17. A method of operating a lamp, comprising:

reducing a temperature differential between a top side and a bottom side of an arc envelope by channeling a cooling medium flow through a structure rotatably mounted relative to the arc envelope towards the top side of the arc envelope, wherein the structure is reorientable in a plurality of different positions of the arc envelope.

18. The method of claim 17, wherein reducing the temperature differential comprises forcing airflow toward the top side and blocking the airflow relative to the bottom side.

19. The method of claim 17, wherein reducing the temperature differential comprises moving a cooling passage relative to the arc envelope to maintain a top side orientation of the cooling passage relative to the top side of the arc envelope.

20. The method of claim 19, wherein moving the cooling passage comprises rotating the cooling passage by gravitational forces.

21. The method of claim 19, wherein moving the cooling passage comprises rotating the cooling passage by electromagnetic forces.

22. The method of claim 17, further comprising exhausting the cooling medium flow through a plurality of openings formed in a reflector enclosing the arc envelope.

23. A method of manufacturing a lamp, comprising:

providing an arc envelope inside a reflector; and providing a cooling mechanism comprising a structure rotatably mounted relative to the arc envelope, wherein the structure is reorientable in a plurality of different positions of the arc envelope to provide at least one cooling passage towards a top side of the arc envelope.

24. The method of claim 23, wherein providing the cooling mechanism comprises providing an airflow blocking structure having a partial disk-shaped structure that is reorientable toward a bottom side of the arc envelope in the plurality of different positions of the arc envelope.

25. The method of claim 23, comprising providing a cooling device adapted to supply a cooling medium through the cooling passage.

* * * * *

UNITED STATES PATENT AND TRADEMARK OFFICE

CERTIFICATE OF CORRECTION

PATENT NO. : 7,901,110 B2
APPLICATION NO. : 11/104984
DATED : March 8, 2011
INVENTOR(S) : Mulay et al.

It is certified that error appears in the above-identified patent and that said Letters Patent is hereby corrected as shown below:

In Column 2, Line 65, delete "microgram" and insert -- micrograin --, therefor.

Signed and Sealed this
Fourteenth Day of June, 2011

David J. Kappos

David J. Kappos
*Director of the United States Patent and Trademark Office*